US005884134A

United States Patent [19]

Karashima et al.

[11] Patent Number: 5,884,134

[45] Date of Patent: Mar. 16, 1999

[54] IMAGE FORMING APPARATUS WITH A DEVICE TO INCREASE CONTACT AREA BETWEEN A TRANSFER SHEET AND AN IMAGE CARRIER

[75] Inventors: Kenji Karashima, Kawasaki; Kohichi Yamazaki, Yokohama; Kentaro Matsumoto, Ichikawa; Kazuhiko Yuuki; Manabu Mochizuki, both of Yokohama; Noriyuki Usui, Kawasaki; Asami Mae, Yokohama; Masakuni Konja, Sohka, all of Japan

[73] Assignee: Ricoh Co., Ltd., Tokyo, Japan

[21] Appl. No.: 878,903

[22] Filed: Jun. 19, 1997

[30] Foreign Application Priority Data

| | | | |
|---|---|---|---|
| Jun. 19, 1996 | [JP] | Japan | 8-178521 |
| Jun. 27, 1996 | [JP] | Japan | 8-186776 |
| Sep. 19, 1996 | [JP] | Japan | 8-248235 |

[51] Int. Cl.[6] ..... G03G 15/16

[52] U.S. Cl. ..... 399/316; 399/315; 399/397

[58] Field of Search ..... 399/315, 316, 399/397, 398, 400, 310, 66; 361/221; 430/126

[56] References Cited

U.S. PATENT DOCUMENTS

| | | | |
|---|---|---|---|
| 3,877,417 | 4/1975 | Jeromin | 118/638 |
| 4,338,017 | 7/1982 | Nishikawa | 399/145 |
| 5,225,879 | 7/1993 | Hayashida | 399/315 |

FOREIGN PATENT DOCUMENTS

| | | |
|---|---|---|
| 49-40548 | 4/1974 | Japan . |
| 58-30775 | 2/1983 | Japan . |
| 61-137178 | 6/1986 | Japan . |
| 62-192776 | 8/1987 | Japan . |
| 63-8159 | 1/1988 | Japan . |
| 63-118779 | 5/1988 | Japan . |
| 1-107280 | 4/1989 | Japan . |
| 3-35275 | 2/1991 | Japan . |
| 4-51178 | 2/1992 | Japan . |
| 5-134493 | 5/1993 | Japan . |
| 6-124791 | 5/1994 | Japan . |

*Primary Examiner*—Joan Pendegrass

*Attorney, Agent, or Firm*—Oblon, Spivak, McClelland, Maier & Neustadt, P.C.

[57] ABSTRACT

An image forming apparatus in which a transfer device is provided in a position separated from an image carrier. A transfer sheet is conveyed along and contacting a part of a circumferential surface of the image carrier facing the transfer device when transferring a toner image from the image carrier to the transfer sheet. A conveying guide is included to guide and covey the transfer sheet separated from the image carrier to a fixing unit. The conveying guide includes a guiding member to direct the conveying direction of the transfer sheet upward when the leading edge of the transfer sheet contacts the guiding member and to convey the transfer sheet at a part of the conveying guide or the guiding member in a position higher than the position of the leading edge of the transfer sheet contacting the conveying guide or the guiding member, so that the contact area between the transfer sheet and the image carrier increases.

30 Claims, 14 Drawing Sheets

IMAGE FORMING APPARATUS WITH A DEVICE TO INCREASE CONTACT AREA BETWEEN A TRANSFER SHEET AND AN IMAGE CARRIER

BACKGROUND OF THE INVENTION

1. Field of the Invention

The present invention relates to an image forming apparatus utilizing electrophotography, such as a copying machine, a facsimile, a printer and the like. The invention more particularly relates to an image forming apparatus in which a toner image formed on a surface of an image carrier is transferred by a transfer device, provided in a position separated from the image carrier, to a recording medium being conveyed contacting and along a part of the circumferential surface of the image carrier facing the transfer device, and after the transfer the recording medium is separated from the image carrier by the bouncing force and the weight of the recording medium itself to be conveyed toward a fixing unit.

2. Discussion of the Background

Image forming apparatus utilizing electrophotography are known and found in such products as copying machines, facsimiles, printers, etc.

An example of a construction of such an image forming apparatus is schematically shown in FIG. 1. FIG. 1 illustrates a photoconductor 1 as an image carrier, which is drum-shaped in this example, a charger 2, optical lighting 3, carrying information of an original document from an optical writing unit utilizing a laser light or an exposure unit exposing an original document, a developing unit 4, a transfer sheet entrance guide member 5, a transfer sheet 6 as a recording medium, such as a transfer paper or a transparent film sheet, a transfer charger 7 capable of corona charging, which is arranged in a position separated from the photoconductor 1, a discharging/separating device 8, a cleaning unit 9, a discharging light 10, a conveying guide plate 11, and a fixing unit 12.

The photoconductor 1 may be alternatively formed in a belt shape, the belt-shaped photoconductor 1 being spanned around a plurality of support rollers so as to rotate, for example.

In FIG. 1, when an image forming operation starts, the photoconductor 1 rotates in a clockwise direction as indicated by an arrow in the drawing. After the charger 2 charges the surface of the photoconductor 1, the optical lighting 3 exposes the surface of the photoconductor 1 to form a latent image thereupon. The latent image is developed to a visible image by toner distributed from the developing unit 4. The image developed by the toner then reaches a transfer area facing the transfer charger 7, where the developed toner image is to be transferred to a transfer sheet 6.

The transfer sheet 6 is fed out from a feeding unit (not shown), and is guided by the transfer sheet entrance guide member 5 to the transfer area synchronized with formation and developing of the latent image on the photoconductor 1. The transfer sheet 6, is conveyed in contact along a circumferential surface of the photoconductor 1 in the transfer area, and charged by the transfer charger 7 with a charge having an opposite polarity to the toner, thereby transferring the toner image on the photoconductor 1 to the transfer sheet 6. The transfer sheet 6 is then discharged by the discharging/separating device 8 to separate the transfer sheet 6 from the surface of the photoconductor 1.

The transfer sheet 6 is then guided by the conveying guide plate 11 to the fixing unit 12, where the toner image is fixed to the transfer sheet 6 by a heat roller and a pressure roller of the fixing unit 12. Then, the transfer sheet 6 is exited to an exit part of the apparatus (not shown).

After the transfer of the toner image to the transfer sheet 6, the surface of the photoconductor 1 is cleaned by the cleaning unit 9 to remove residual toner therefrom and is discharged by the discharging light 10. Thus, an operation for forming an image is completed. When making multiple images, the above operation is repeated.

In such an image forming apparatus as described above, when transferring a toner image from the photoconductor 1 to the transfer sheet 6, the transfer sheet 6 needs to contact the surface of the photoconductor 1, and additionally maintain a sufficient contact area of the transfer sheet 6 with the photoconductor 1 along a circumferential surface of the photoconductor 1. When such a contact area is not sufficient, for example when the period of time during which the transfer sheet 6 is conveyed while contacting the photoconductor 1 becomes short, the conveying direction of the transfer sheet 6 becomes unstable after transfer of the image from the photoconductor 1, and, as a result, jamming of the transfer sheet 6 occurs. Further, because the period of time during which the image is transferred becomes short, it occurs that the toner image is not sufficiently transferred, resulting in deterioration of image quality.

The contact area of the photoconductor 1 and the transfer sheet 6 becomes larger if the diameter of the drum-shaped photoconductor 1 is made larger. When the photoconductor 1 is belt-shaped, the contact area is made larger by arranging the support rollers supporting the belt-shaped photoconductor 1 so as to increase the radius of the curvature of the belt at the position where the transfer sheet 6 contacts the belt and an image is transferred. As the contact area becomes larger, it becomes more difficult to separate the transfer sheet 6 from the photoconductor 1 after the image is transferred to the transfer sheet. Therefore, generally, when the contact area between the photoconductor 1 and the transfer sheet 6 is made relatively large, a separating device such as the discharging/separating device 8 is used to separate the transfer sheet 6 from the photoconductor 1, which increases complexity of construction and raises the cost of the apparatus.

On the other hand, if the diameter of the drum-shaped photoconductor 6 is made smaller, or the radius of the curvature of the belt-shaped photoconductor 1 at the point of the transfer is made smaller, separation of the transfer sheet 6 from the photoconductor 1 becomes easier because of the increased curvature of the photoconductor 1. In this arrangement, the transfer sheet 6 separates from the photoconductor 1 by a bouncing force and weight of the transfer sheet 6 itself, and the separating device becomes unnecessary.

However, with a small-diameter photoconductor 1 or a belt-shaped photoconductor 1 with a smaller radius of the curvature at the transfer point, the contact area of the transfer sheet 6 and the photoconductor 1 becomes insufficient. As described above, insufficient contact area causes unstable conveying of the transfer sheet 6 and insufficient image transfer, resulting in jamming of the transfer sheet 6 and deterioration of the image quality.

In more detail, image density decreases because of insufficient charging due to insufficient contact time. Further, image blurring occurs due to uneven charge across the transfer sheet 6 at the time of transfer. Uneven charge across the transfer sheet 6 is caused, for example, by uneven electric charge caused by dust on a wire electrode of the transfer charger 7 or uneven leaking of a charge through the transfer sheet 6 due to uneven moisture absorption of the transfer sheet 6. The uneven charge is generally eliminated if the contact area between the transfer sheet 6 and the photoconductor 1 is large enough and the contacting time is long enough at the time of transfer. The problem of image deterioration due to uneven charge caused by leaking of the charge through the transfer sheet 6 at the time of transfer is particularly significant under high humidity conditions because resistance of the transfer sheet 6 decreases due to increased moisture in the transfer sheet.

SUMMARY OF THE INVENTION

Accordingly, an object of the present invention is to provide a novel image forming apparatus of a relatively simple construction which is capable of accomplishing a sufficient contact area between a transfer sheet and an image carrier to achieve sufficient transfer of a toner image to the transfer sheet from the an image carrier. Another object is to stably convey the transfer sheet after transfer of the toner image even when the diameter of the drum-shaped image carrier or the radius of the curvature of the belt-shaped image carrier at the point of the toner image transfer is relatively small and a transfer device is arranged in a position separated from the image carrier.

In order to achieve the above and other objects, an image forming apparatus is provided a transfer device in a position separated from an image carrier. A transfer sheet is conveyed in contact with a part of the circumferential surface of the image carrier facing the transfer device when transferring a toner image from the image carrier to the transfer sheet. A conveying guide is included to guide and convey the transfer sheet after separation from the image carrier to a fixing unit. The conveying guide includes a guiding member to direct the direction of the transfer sheet upward when the leading edge of the transfer sheet contacts the guiding member and to convey the transfer sheet at a part of the conveying guide or the guiding member in a position higher than the position of the leading edge of the transfer sheet contacting the conveying guide or the guiding member, so that the contact area of the transfer sheet with the image carrier increases.

The guiding member may be provided to the conveying guide extending upward from the conveying guide and inclining toward the conveying direction of the transfer sheet.

Alternatively, the guiding member may be formed integrally with the conveying guide at a side of the transfer device, extending downward therefrom and inclining toward the direction opposite to the direction of conveying the transfer sheet, and further, being arranged so that the leading edge of the conveyed transfer sheet contacts the guiding member.

Further, a discharging device for discharging a transfer sheet separated from the image carrier may be provided to the guiding member and arranged so as to direct the conveying direction of the transfer sheet upward when it contacts the discharging device.

Alternatively, a discharging device for discharging a transfer sheet separated from the image carrier may be configured so as to work as the guiding member to direct the conveying direction of the transfer sheet separated from the image carrier upward when it contacts the discharging device so that the contact area of the transfer sheet with the image carrier increases.

Further, a conductive grounding member contacting the transfer sheet may be provided at the upstream of the transfer device and the conveying guide at the downstream of the transfer device is made conductive, and the conductive grounding member at the upstream of the transfer device and the conveying guide are arranged so that the transfer sheet contacts at least either of the conductive grounding member and the conveying guide when transferring an image to uniformly leak the charge applied to the transfer sheet to avoid occurrence of uneven charge on the transfer sheet.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
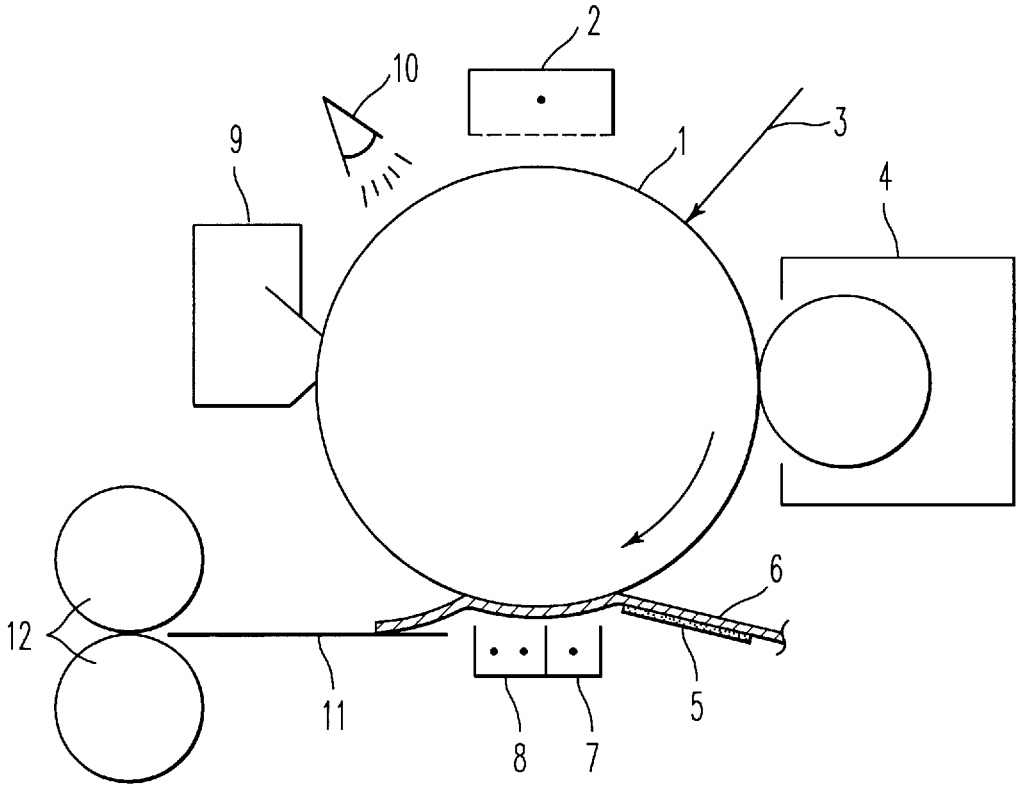
FIG. 1 is a schematic drawing illustrating an example of a construction of a conventional image forming apparatus.

Referring now to the drawings, wherein like reference numerals designate identical or corresponding parts throughout the several views, the embodiments of the present invention are explained herein below.

Figure 2:
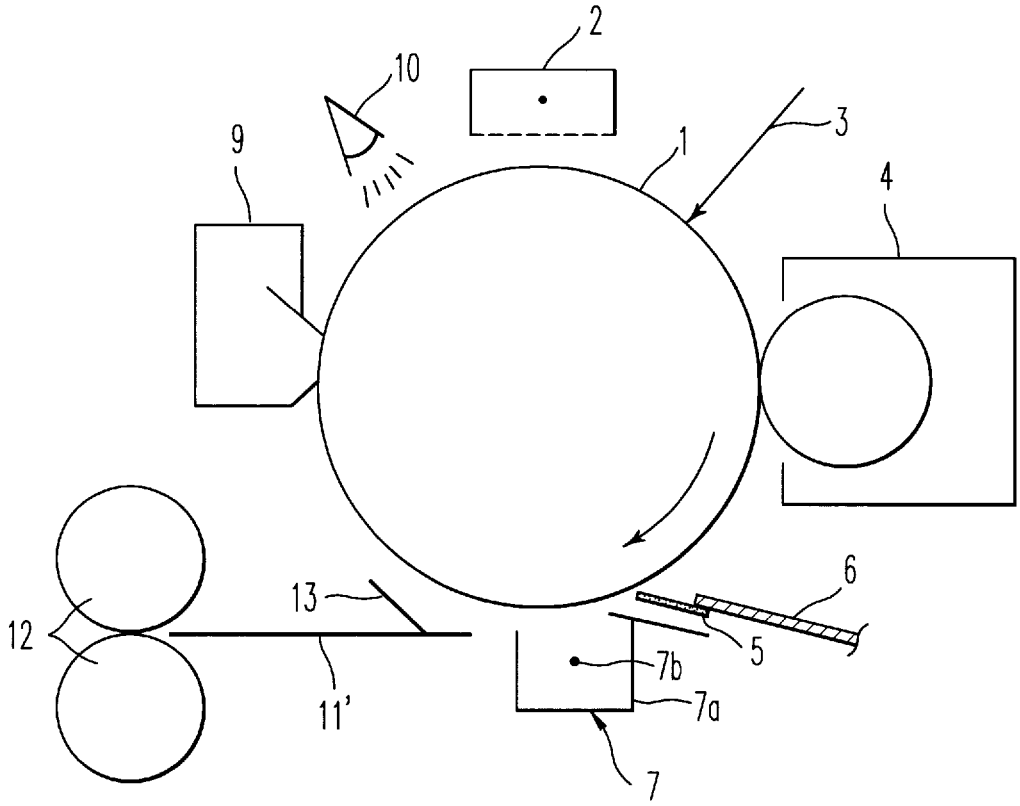
FIG. 2 is a schematic drawing illustrating the main parts of an embodiment of an image forming apparatus of the present invention.

FIG. 2 is a schematic drawing illustrating a construction of the main parts of an image forming apparatus according to the present invention. FIG. 2 includes a drum-shaped photoconductor 1 as an image carrier, a charger 2, an optical lighting 3 which carries information of an original document from an optical writing unit utilizing a laser light or an exposure unit exposing the original document (not shown), a developing unit 4, a transfer sheet entrance guide member 5, a transfer sheet 6 such as a transfer paper, transparent film sheet or the like, a transfer charger 7 capable of corona charging, a casing 7*a* of the transfer charger 7, a wire electrode 7*b*, a cleaning unit 9, a discharging light 10, a conveying guide member 11' in a plate shape (hereinafter referred to as the conveying guide plate 11') and a fixing unit 12.

In the image forming apparatus of FIG. 2, an image forming operation is performed in the same manner as described above. However, in this embodiment, the diameter of the drum-shaped photoconductor 1 is made smaller than the one in the prior art, to 30 mm in this example, and a device for separating the transfer sheet 6 from the photoconductor 1 after transfer of an image thereupon, such as the discharging/separating device 8 in FIG. 1, is not included. Further, a guiding member 13, which is made of Mylar in a plate shape in this example, is provided to the conveying guide plate 11' extending upward and inclining in the transfer sheet conveying direction at the side of and after the transfer charger 7 in the transfer sheet conveying direction.

In FIG. 2, when an image forming operation starts, the photoconductor 1 rotates in a direction indicated by an arrow in the drawing. After the charger 2 charges the surface of the photoconductor 1, the optical lighting 3 exposes a surface the photoconductor 1 to form a latent image thereon. The latent image is developed to a visible image by toner in a developer contained in the developing unit 4. The toner image then reaches a transfer area where the toner image is transferred from the photoconductor 1 to the transfer sheet 6, that is, an area where the transfer charger 7 faces the photoconductor 1 and where charging from the wire electrode 7*b* reaches. The transfer sheet 6 is fed from a transfer sheet feeding unit (not shown) guided by the transfer sheet entrance guide member 5 to the transfer area synchronized with formation and developing of the latent image. The transfer sheet 6, while being conveyed and contacting along the circumferential surface of the photoconductor 1 in the transfer area, is charged by the transfer charger 7 with a charge having an opposite polarity to the toner, and thereby the toner image on the photoconductor 1 is transferred to the transfer sheet 6.

Figure 4:
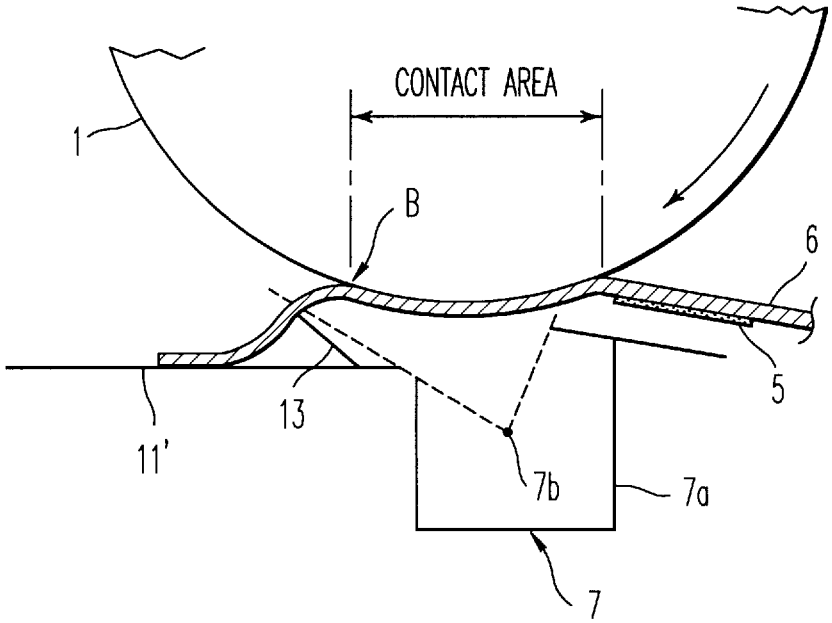
FIG. 4 is a schematic drawing further illustrating the conveying direction of the transfer sheet in the embodiment.

After the transfer of the toner image, the transfer sheet 6 is separated from the surface of the photoconductor 1 by a bouncing force and weight of the transfer sheet 6. A leading edge of the transfer sheet 6 then reaches the guiding member 13, and the conveying direction of the transfer sheet 6 is directed. Then, the transfer sheet 6 is conveyed, while passing over the guiding member 13, as shown in FIG. 4, in a position higher that the position of the leading edge of the transfer sheet 6 contacting the conveying guide plate 11'.

Figure 3:
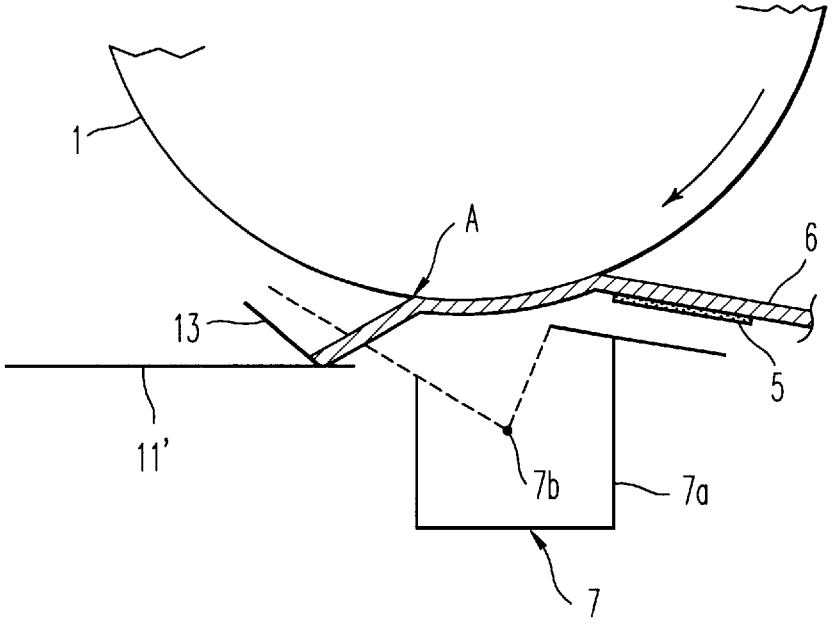
FIG. 3 is a schematic drawing illustrating a conveying direction of a transfer sheet in the embodiment.

The point where the leading edge of the transfer sheet 6 separates from the surface of the photoconductor 1 is a point A as shown in FIG. 3. The leading edge of the transfer sheet 6 then reaches the guiding member 13 provided to the conveying guide plate 11'. As the leading edge of the transfer sheet 6 is raised along the surface of the guiding member 13, the conveying position of the transfer sheet 6 is raised relative to the conveying guide plate 11' towards the photoconductor 1 and the separation point A changes in a direction downstream of the rotation of the photoconductor 1. When the leading edge of the transfer sheet 6 reaches a position shown in FIG. 4 after passing the guiding member 13, the separation point of the transfer sheet 6 from the photoconductor 1 changes to a point B in FIG. 4. Accordingly, the contact area between the photoconductor 1 and the transfer sheet 6 increases, and as a result, sufficient image transfer and stable conveyance of the transfer sheet 6 after the transfer are achieved.

Figure 5:
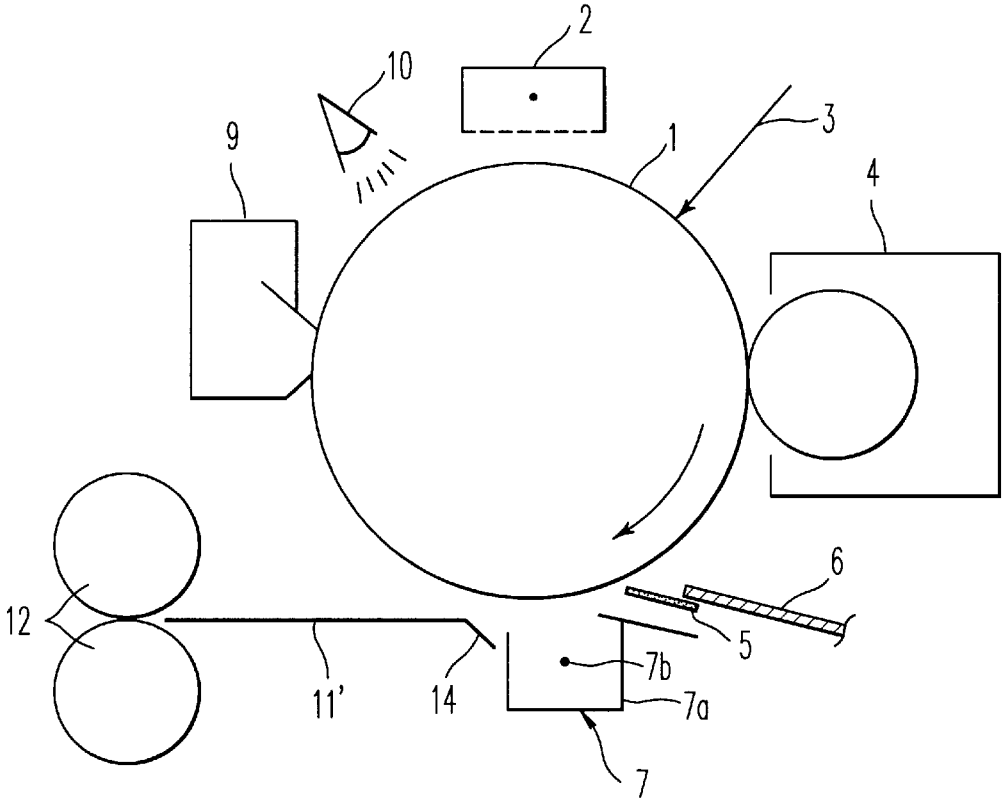
FIG. 5 is a schematic drawing illustrating a second embodiment.

FIG. 5 is a schematic drawing illustrating a construction of a second embodiment. In this embodiment, an image forming operation is performed in the same manner as described earlier, however, instead of the guiding member 13 which is provided to the conveying guide plate 11' as shown in FIG. 2, the conveying guide plate 11' is bent downward at the side of the transfer charger 7 to form a slanted part 14 slanting in a direction opposite to the transfer sheet conveying direction. By forming the slanted part 14 integrally with the conveying guide plate 11', the cost of the apparatus is reduced.

Figure 6:
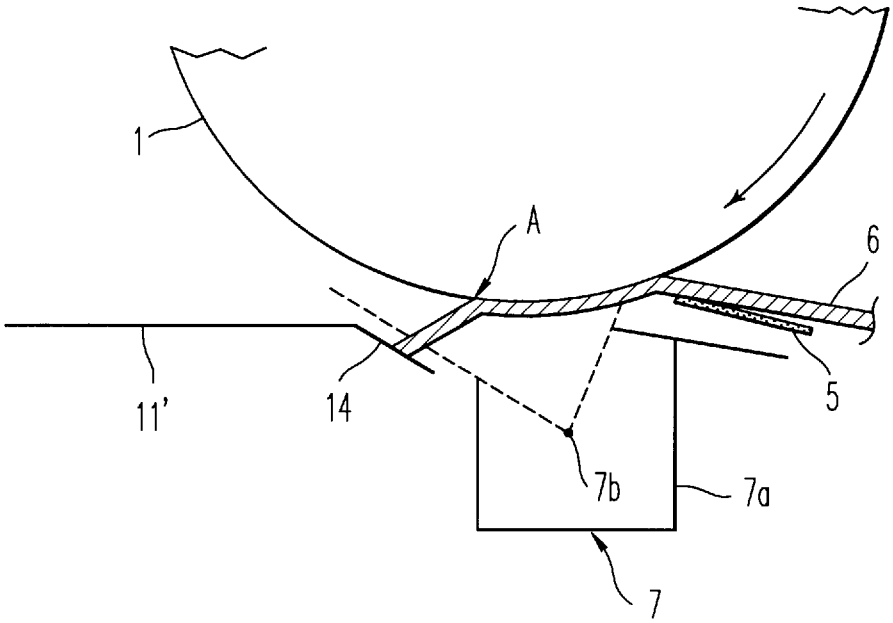
FIG. 6 is a schematic drawing illustrating a conveying direction of the transfer sheet in the second embodiment.

As in the previous embodiment, the transfer sheet 6 separates from the photoconductor 1 by the bouncing force and the weight of the transfer sheet 6 after an image is transferred thereon from the photoconductor 1. The leading edge of the transfer sheet 6 then contacts the slanted part 14 of the conveying guide plate 11' as shown in FIG. 6, and the conveying direction of the leading edge of the transfer sheet 6 is directed upward by the slanted part 14. The leading edge of the transfer sheet 6 is advanced along the surface of the slanted part 14, and then conveyed, along a flat surface of the conveying guide plate 11', which is in a position higher than the point of the leading edge of the transfer sheet 6 contacting the slanted part 14, to the fixing unit 12.

Figure 7:
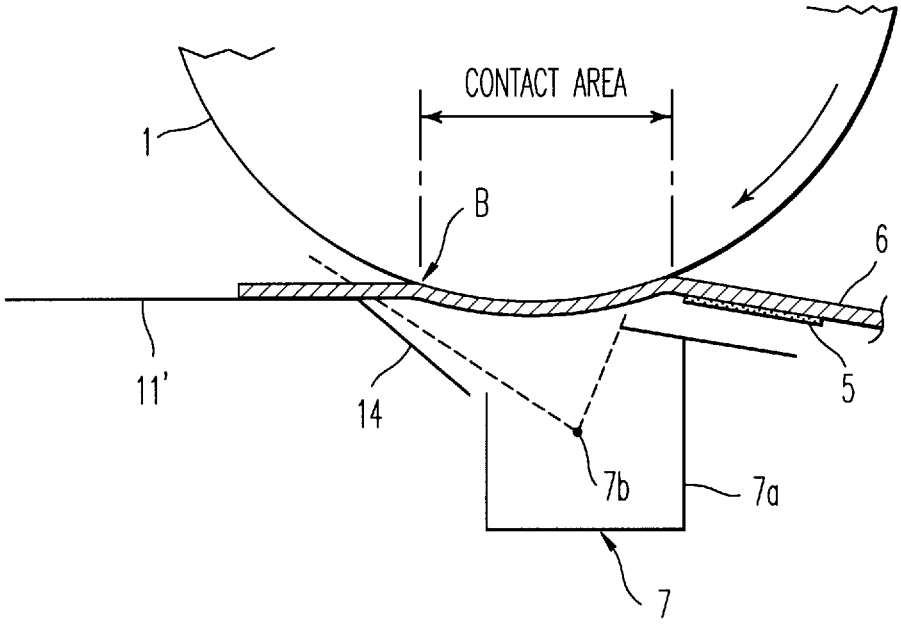
FIG. 7 is a schematic drawing further illustrating the conveying direction of the transfer sheet in the second embodiment.

In this embodiment, because the conveying position of the transfer sheet 6 is raised by the conveying guide plate 11' towards the photoconductor 1, the separating point of the transfer sheet 6 from the photoconductor 1 changes from a point A in FIG. 6 to a point B in FIG. 7. Therefore, the contact area between the transfer sheet 6 and the photoconductor 1 increases and thereby sufficient image transfer and stable conveying of the transfer sheet 6 after the transfer are achieved.

Figure 8:
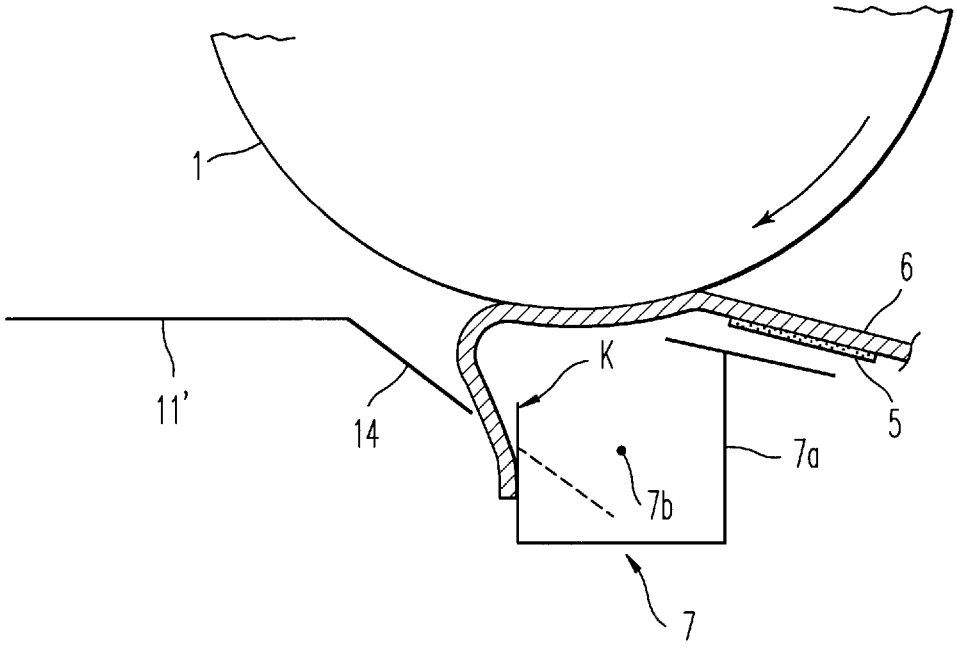
FIG. 8 is a schematic drawing illustrating a third embodiment and further explaining an example of a conveying direction of the transfer sheet.

Next, a third embodiment is explained with reference to FIG. 8. In FIG. 8, an image forming operation is performed in the same manner as the previous embodiments. In this embodiment, the conveying guide plate 11' is so configured and arranged that an extension line extending from a free end of the slanted part 14 does not enter inside of the casing 7*a* of the transfer charger 7. In other words, as shown in FIG. 8, the slanted part 14 is configured and arranged so that the extension line extending from the free end of the slanted part 14, which is indicated by a dotted line in the drawing, crosses the plane of the casing 7*a* at the transfer sheet exiting side at a point below an edge K of the casing 7*a*. Therefore, even when the transfer sheet 6 is conveyed into an area below the slanted part 14 due to its weak stiffness, weak bouncing force, or due to curling, as shown in FIG. 8, the transfer sheet 6 is prevented from entering inside of the casing 7*a* of the transfer charger 7, and damaging and/or dislocating the wire electrode 7*b* inside of the transfer charger 7 is avoided.

Experimental results are shown below, comparing results of transferring an image between the image forming apparatus of the present invention with the conveying guide plate 11' shown in FIG. 8 and the conventional image forming apparatus with the conveying guide plate 11 shown in FIG. 1. In both apparatus, a drum-shaped photoconductor 1 with a 30 mm diameter is used and the photoconductor 1 is rotated at a speed of 90 mm/sec. A two component developer is used for the development unit 4, and as the transfer sheet 6 a paper called Type 6200 which is manufactured by Ricoh Company, Ltd. is used. The experiment was made under three different temperature and humidity conditions, the first with 10° C./15% representing low temperature and low humidity conditions, the second with 23° C./60% representing normal temperature and humidity conditions and the third with 30° C./90% representing high temperature and high humidity conditions. An image, whose entire surface is solid, was formed and transferred to one side of the transfer sheet 6 for one case and for another case the image was transferred to both sides of the transfer sheet 6. When the image was transferred to both sides of the transfer sheet 6, the image transferred to the second side of the transfer sheet 6 was evaluated. The evaluation result is shown in the table 1 below.

[TABLE 1]

| | Temperature/Humidity | | | | | |
|---|---|---|---|---|---|---|
| | 10° C./15% | | 23° C./60% | | 30° C./90% | |
| One side/both sides | one side | both sides | one side | both sides | one side | both sides |
| Conventional guide plate | Δ | X | O | Δ | O | Δ |
| Guide plate of the invention | O | O | O | O | O | O |

In the table, an O mark indicates that the image transfer was satisfactory, an X mark indicates that the image transfer was unsatisfactory over the entire surface of the transfer sheet 6, and a A mark indicates that the image transfer was unsatisfactory at some parts of the transfer sheet 6.

As shown in the above table 1, even when the photoconductor 1 is a small-diameter, such as 30 mm, a sufficient contact area between the transfer sheet 6 and the photoconductor 1 is achieved with the inclined part 14 provided to the conveying guide plate 11' at the side of the transfer charger 7, and sufficient and stable image transfer is accomplished even under low humidity conditions and when an image is transferred on both sides of the transfer sheet 6.

Next, a fourth embodiment is explained referring to FIGS. 9–15. As described in the earlier embodiments, if the diameter of the photoconductor 1 is made smaller, separation of the transfer sheet 6 from the photoconductor 1 becomes easier because of the larger curvature of the photoconductor 1, and the transfer sheet 6 separates from the photoconductor 1 by the bouncing force and the weight of the transfer sheet 6 itself, thereby a device for separating the transfer sheet 6 from the photoconductor 1, such as the discharging/separating charger 8 in FIG. 1 becomes unnecessary.

However, if the discharging/separating charger 8 is eliminated, the transfer sheet 6 is not discharged after the transfer of the image, and quality of the transferred image deteriorates. For example, under low humidity conditions, resistance of the transfer sheet 6 increases and therefore the charge applied when transferring the image remains on the transfer sheet 6. When the transfer sheet 6 contacts a conductive part of the apparatus while being conveyed to the fixing unit 12, that is, before the toner image is fixed to the transfer sheet 6, the remaining charge of the transfer sheet 6 leaks through a part of the transfer sheet 6 contacting the conductive part and a part of the toner image on such contact part of the transfer sheet 6 is disordered, i.e., the image is blurred. Therefore, it is preferable to include a device to uniformly discharge the transfer sheet 6 after transfer of an image.

In this embodiment, therefore, a discharging device is included for the purpose of uniformly discharging the transfer sheet 6 after image transfer. The discharging device is utilized as the guiding member to direct the conveying direction of the transfer sheet 6.

Figure 9:
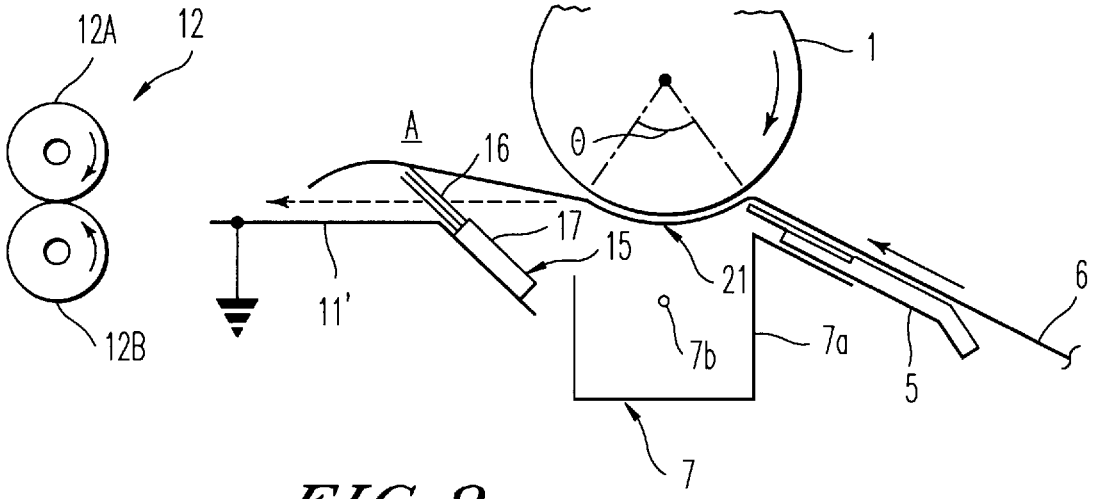
FIG. 9 is schematic drawing illustrating the main parts of a fourth embodiment including a discharger.

FIG. 9 is a schematic drawing showing a construction of the main parts of an image forming apparatus including the above described discharging device. In the apparatus, the transfer sheet 6 is charged to a given charge when transferring an image by means of corona charging by the wire electrode 7*b* of the transfer charger 7. Discharger 15 is provided at the exiting side or downstream of the transfer charger 7 for discharging the transfer sheet 6 which has been separated from the photoconductor 1 after image transfer. An example of discharging technology is proposed in Japanese Patent application No. Tokukaihei 7-36287, which is incorporated herein as reference.

The discharger 15 includes a conductive brush 16 and a brush support member 17 which is conductive and supports the conductive brush 16 at a base end side of the conductive brush 16. The brush support member 17 is fixed to the conveying guide plate 11' along and contacting the surface of the conveying guide plate 11' which is conductive and is grounded, thereby grounding the conductive brush 16. The transfer sheet 6, which is separated from the photoconductor 1 after image transfer, is discharged when it contacts the conductive brush 16 of the discharger 15 configured as above.

In this embodiment, the discharger 15 is so arranged that the conveying direction of the transfer sheet 6 after separating from the photoconductor 1 after image transfer is directed upward when the leading edge of the transfer sheet 6 contacts the discharger 15. In more detail, after the leading edge of the transfer sheet 6 separates from the photoconductor 1, the leading edge of the transfer sheet 6 contacts the conductive brush 16, and the conveying direction of the leading edge of the transfer sheet 6 is directed upward. The leading edge of the transfer sheet 6 is conveyed along the conductive brush 16 and then along the conveying guide plate 11'. The transfer sheet 6 is further conveyed to pass over the conductive brush 16, as shown in FIG. 9, while being discharged by the brush 16, in a position higher than the position of the leading edge of the transfer sheet 6. By thus raising the conveying position of the transfer sheet 6 towards the photoconductor 1, the contact area between the transfer sheet 6 and the photoconductor 1 is increased as compared to a case where the transfer sheet 6 is conveyed in a direction indicated by a dotted line in FIG. 9, which illustrates the transfer sheet conveying position when the discharger 15 configured as above is not provided.

Because the transfer sheet 6 is raised upward, the contact area with the photoconductor 1 increases after the leading edge of the transfer sheet 6 is separated from the photoconductor 1, resulting in sufficient image transfer and stable conveyance. Because the discharger 15 and the conductive brush 16 provide uniform discharging, the separation characteristics of the transfer sheet 6 from the photoconductor 1 does not deteriorate the transferred image.

Further, because the discharger 15 performs both directing the conveying direction of the transfer sheet 6 upward for increasing the contact area of the transfer sheet 6 with the photoconductor 1 and discharging the transfer sheet 6 after transfer of the image, the number of parts is reduced and consequently the construction of the apparatus is simplified.

Figure 10:
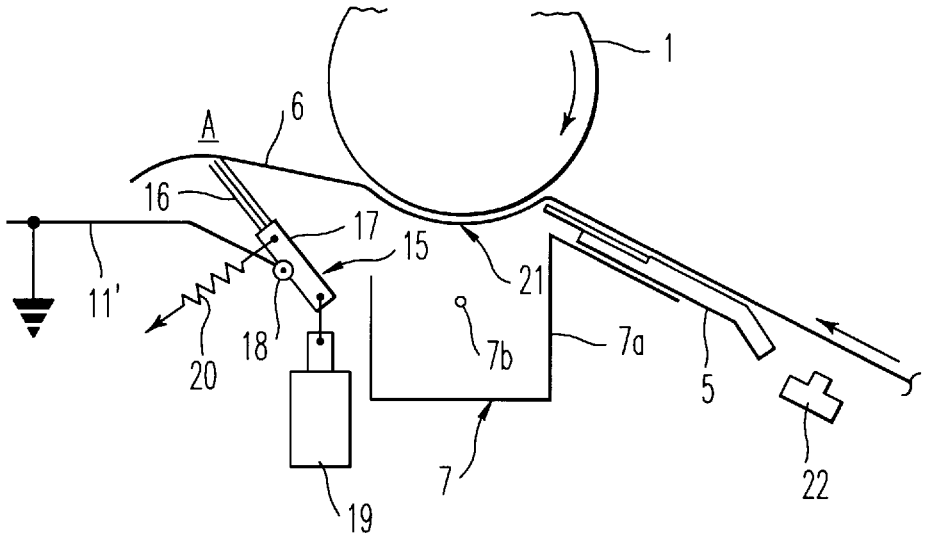
FIG. 10 is a schematic drawing illustrating the fourth embodiment including another discharger.
Figure 11:
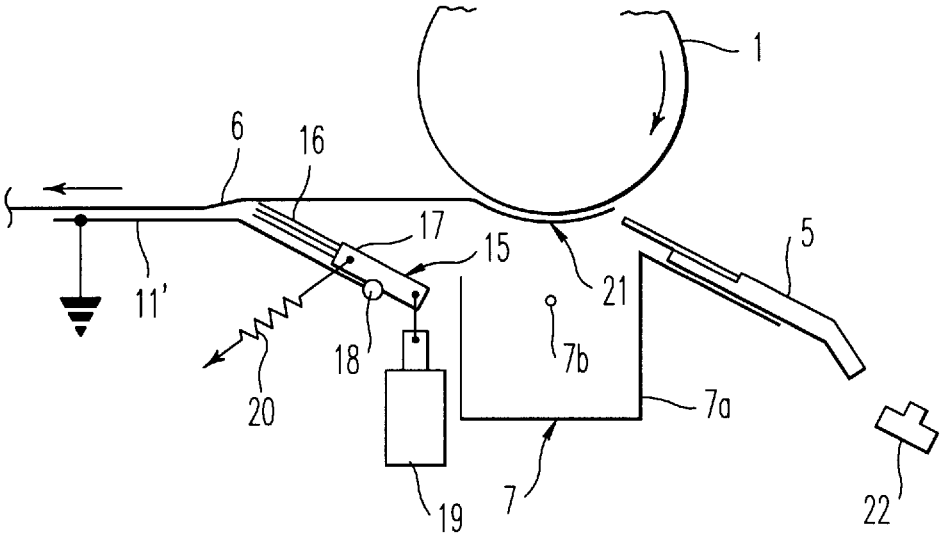
FIG. 11 is a schematic drawing illustrating a state of the discharger shown in FIG. 10.
Figure 12:
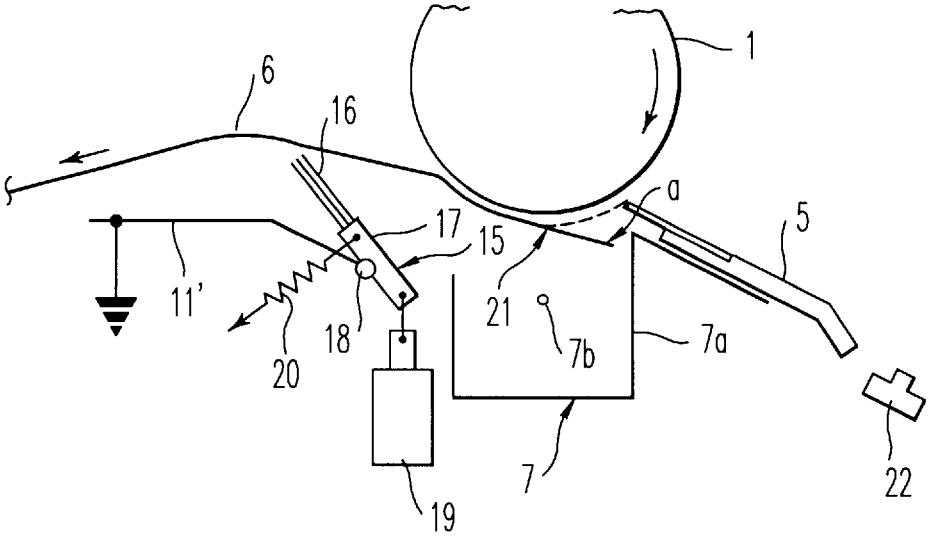
FIG. 12 is a schematic drawing illustrating another state of the discharger and explaining further a problem occurring in such a state.

As shown in FIG. 10, the discharger 15 may be mounted to the conveying guide plate 11' in a way that the discharger 15 is rotatable around a fulcrum 18 at which the discharger 15 is mounted. FIG. 10 shows a state that the discharger 15 is in a raised position to direct the conveying direction of the transfer sheet 6 upward, forming a convex curve in the transfer sheet 6 toward a side of the photoconductor 1. FIG. 11 shows a state of the discharger 15 is in a position recessed from the raised position.

As shown in FIGS. 10–13, the discharger 15 includes a solenoid 19 at the end of the brush support member 17. When the solenoid 19 is activated, the discharger 15 moves to and is held in the raised position to direct the conveying direction of the transfer sheet 6 upward. When the solenoid 19 is released (not activated), the discharger 15 rotates in a counterclockwise direction around the fulcrum 18 to the recessed position shown in FIG. 11 by a pulling force of a spring 20 provided between the brush support member 17 and a side plate of a main body of the apparatus (not shown). Thus, in this embodiment, the discharger 15 is supported so as to be movable between the raised position to direct the conveying direction of the transfer sheet 6 upward and the recessed position.

Further, there is provided a means for activating the discharger 15 to move from the raised position to the recessed position immediately before the trailing edge of the transfer sheet 6 reaches a transfer area 21 where an image is transferred.

In FIG. 10, the transfer sheet 6 is conveyed in a direction indicated by an arrow from a transfer sheet feeding device (not shown), toward the transfer area 21. There is provided a sensor 22 for detecting the transfer sheet 6 upstream of the transfer sheet entrance guide member 5 in the transfer sheet conveying direction.

The discharger 15 is held in the recessed position shown in FIG. 11 until the leading edge of the transfer sheet 6 reaches the sensor 22. When the sensor 22 detects the leading edge of the transfer sheet 6, the solenoid 19 is activated by a detect signal from the sensor 22, and thereby the discharger 15 rotates from the recessed position to the position to raise the transfer sheet 6 as shown in FIG. 10. Thus, the discharger 15 is moved by the solenoid 19 upon the detect signal from the sensor 22 to raise the transfer sheet 6 before image transfer starts. The conveying direction of the transfer sheet 6 is directed upward when the leading edge of the transfer sheet 6 contacts the discharger 15. The discharger 15 further forms a convex curve in the transfer sheet 6, after passing through the transfer area 21, toward an area at the side of the photoconductor 1 denoted as A in FIG. 10.

The solenoid 19 is released immediately before the trailing edge of the transfer sheet 6 reaches the transfer area 21. In more detail, the solenoid 19 is released a predetermined time t after the trailing edge of the transfer sheet 6 is detected by the sensor 22. The time t is a period of time during which the trailing edge of the transfer sheet 6 is conveyed from the position detected by the sensor 22 to a position immediately before the transfer area 21. There may be provided a controller including a timer to activate and release the solenoid 19 in a manner as described above. Such a controller may be conveniently implemented using a conventional microprocessor programmed according to the teachings of the present specification, as will be apparent to those skilled in the computer art.

When the solenoid 19 is released, the discharger 15 is pulled to the recessed position shown in FIG. 11 by a pulling force of the spring 20. The discharger 15 is rotated to the recessed position where the discharger 15 does not form a convex curve in the transfer sheet 6 toward the side of the photoconductor 1 or the discharger 15 forms a convex curve in the transfer sheet 6 of a curvature less than a curvature when the solenoid 19 is activated. Thus, the conveying direction of the transfer sheet 6 returns to the direction indicated by the dotted line in FIG. 9.

In FIG. 10, the transfer sheet 6 is compulsorily raised upward by the transfer sheet entrance guide member 5 with a point where the transfer sheet 6 contacts the photoconductor 1 as the fulcrum. Further, when the discharger 15 is in the raised position, the transfer sheet 6 is compulsorily raised upward by the discharger 15 with the transfer area 21 as the fulcrum. If the transfer sheet 6 is being held by the discharger 15 at the position shown in FIG. 12 when the trailing edge of the transfer sheet 6 passes the transfer sheet entrance guide member 5, the trailing edge of the transfer sheet 6 bounces in a direction indicated by an arrow 'a' in FIG. 12 due to stiffness of the transfer sheet 6 itself, causing separation from the surface of the photoconductor 1. This causes inferior image transfer at the trailing edge of the transfer sheet 6. This problem is significant when the stiffness of the transfer sheet 6 is relatively high.

For preventing this problem, therefore, the discharger 15 is moved to the recessed position immediately before the trailing edge of the transfer sheet 6 reaches the transfer area 21, that is, immediately before the trailing edge of the transfer sheet 6 passes through the transfer sheet entrance guide member 5. Thus, even when the transfer sheet 6 has relatively high stiffness, bouncing of the trailing edge of the transfer sheet 6 is prevented, avoiding inferior transfer of an image at the trailing edge of the transfer sheet 6.

The sensor 22 which is provided in the position immediately before the transfer area 21 may be combined with a sensor for detecting jamming of the transfer sheet 6.

Figure 13:
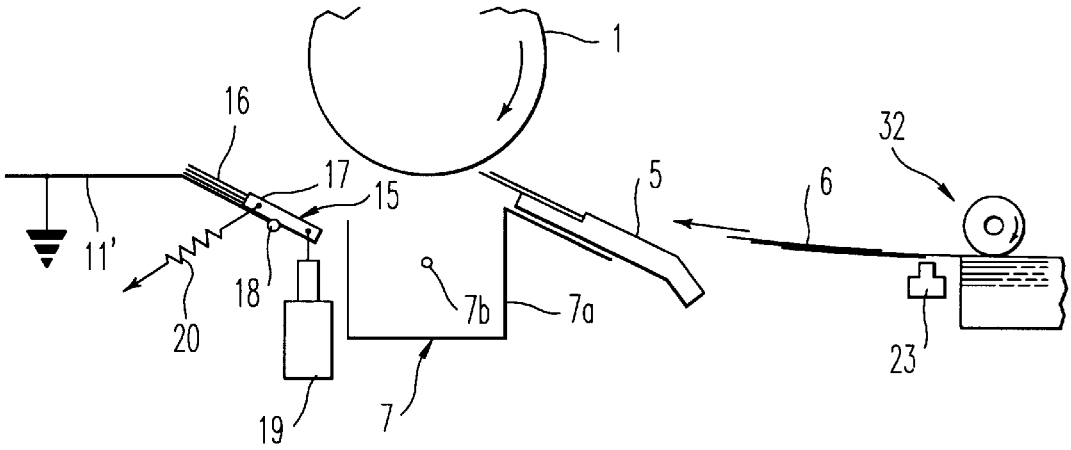
FIG. 13 is a schematic drawing illustrating another embodiment including a sensor to detect jamming of the transfer sheet for controlling the discharger.

In FIG. 13, there is provided a transfer sheet jamming sensor 23 for detecting jamming of the transfer sheet 6 in the downstream of a transfer sheet feeding unit 32 in the transfer sheet conveying direction. The function of sensor 22 provided in the previous embodiment for activating and releasing the solenoid 19 may be provided by the transfer sheet jamming sensor 23. The solenoid 19 is controlled to be released after a time T after the trailing edge of the transfer sheet 6 is detected by the jamming sensor 23, in which the time T is a period of time during which the trailing edge of the transfer sheet 6 is conveyed from a point to be detected by the jamming sensor 23 to reach a place immediately before the transfer area 21.

Figure 14:
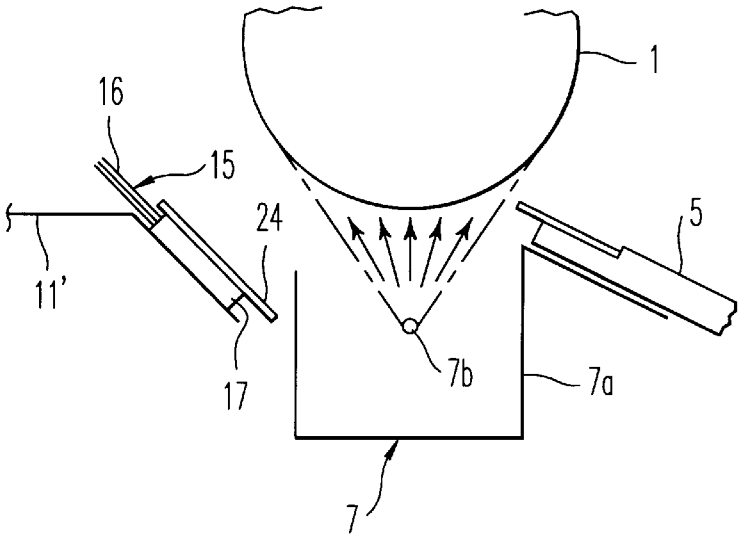
FIG. 14 is a schematic drawing illustrating another embodiment including an insulating member at the discharger.

Next, another example of the discharger 15 is explained referring to FIG. 14. As shown in FIG. 14, an insulating member 24 is provided to the discharger 15 at a part facing the transfer charger 7. In this example, the insulating member 24 is stuck to the brush support member 17 which is conductive. The brush support member 17 is fixed and electrically connected to the conveying guide plate 11' at the other plane.

Figure 15:
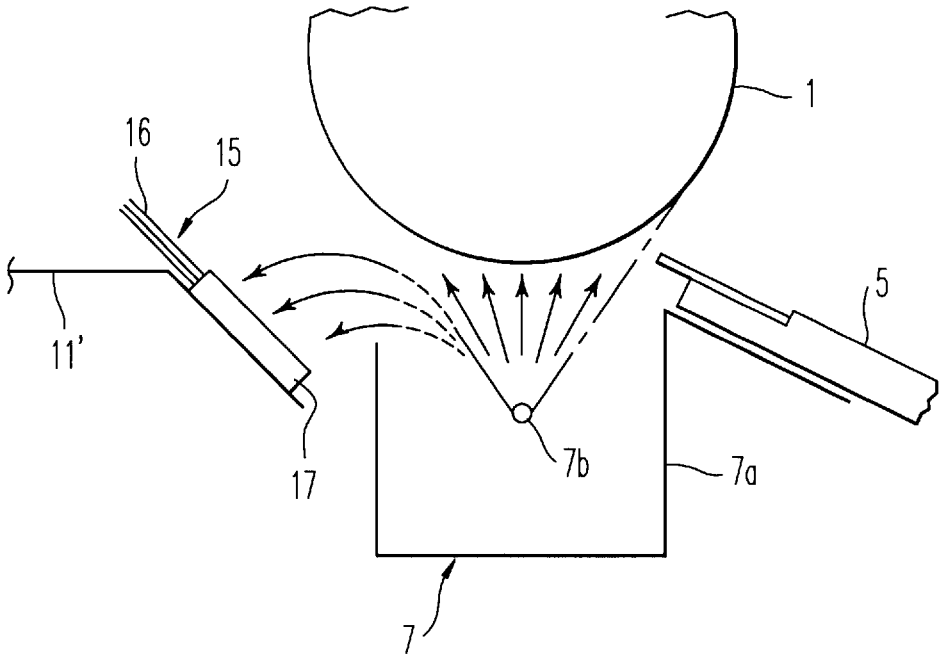
FIG. 15 is a schematic drawing explaining leakage of transfer charge toward the discharger.

As described earlier, when transferring an image, a voltage is applied to the wire electrode **7*b* of the transfer charger 7 for corona charging between the wire electrode 7*b* and the photoconductor 1. The corona charging flows towards the photoconductor 1 in a direction indicated by a group of arrows in FIG. 14. When the discharger 15 is arranged close to the transfer charger 7, there is a possibility that a part of the corona charging from the wire electrode 7***b* leaks in a different direction. In FIG. 15, arrows heading toward the brush support member 17 indicate leaked corona charge. If the corona charge leaks, a resulting image transfer is unsatisfactory due to insufficient charging.

Such leakage of the corona charging is prevented in the embodiment by fixing the insulating member 24 to the brush support member 17 at the plane facing the transfer charger 7 as shown in FIG. 14.

It is needless to say that an insulating member similar to insulating member 24 may be provided to the discharger 15 described in the earlier embodiments to prevent leakage of the corona charge.

If the discharger 15 is provided and the transfer sheet 6 which has been separated from the photoconductor 1 after transfer of an image is discharged by the discharger 15 as explained above, occurrence of deterioration of the transferred image under low humidity conditions is avoided.

Further, under high humidity conditions, the discharging device, such as the discharger 15, leaks the charge, which is applied by the transfer charger 7 to the transfer sheet 6 when transferring an image, uniformly through the discharger 15. Therefore, uneven charge across the transfer sheet 6, which is caused, for example, by uneven charge from the wire electrode 7*b* of the transfer charger 7 or uneven leakage of the charge through the transfer sheet 6 due to uneven moisture of the transfer sheet 6, does not occur, and consequently image deterioration such as blurring does not occur.

However, though the structure of the discharger 15 as shown in FIGS. 9 and 10 is simple and cost of the unit is relatively low, provision of the discharger 15 may offset the cost reduction which is achieved by eliminating the device to separate the transfer sheet 6 from the photoconductor 1 by the use of the small-diameter photoconductor 1.

Figure 16:
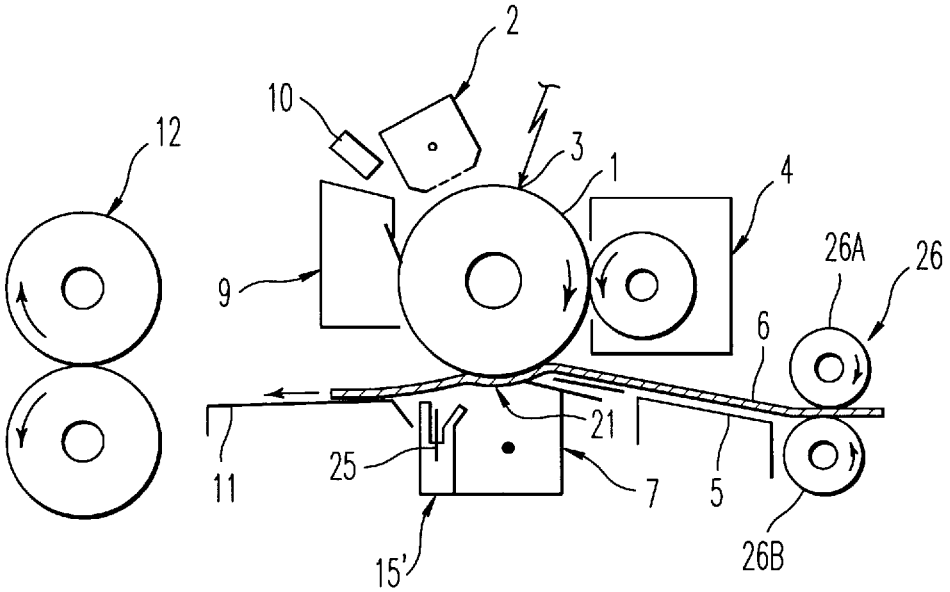
FIG. 16 PRIOR ART
FIG. 16 is a schematic drawing illustrating construction of a conventional image forming apparatus including a discharging device.

An as alternative, instead of the discharger 15 as shown in FIG. 9 and 10, FIG. 16 illustrates a discharging device 15' arranged downstream of the transfer charger 7 in the transfer sheet conveying direction next to the transfer charger 7.

Figure 17:
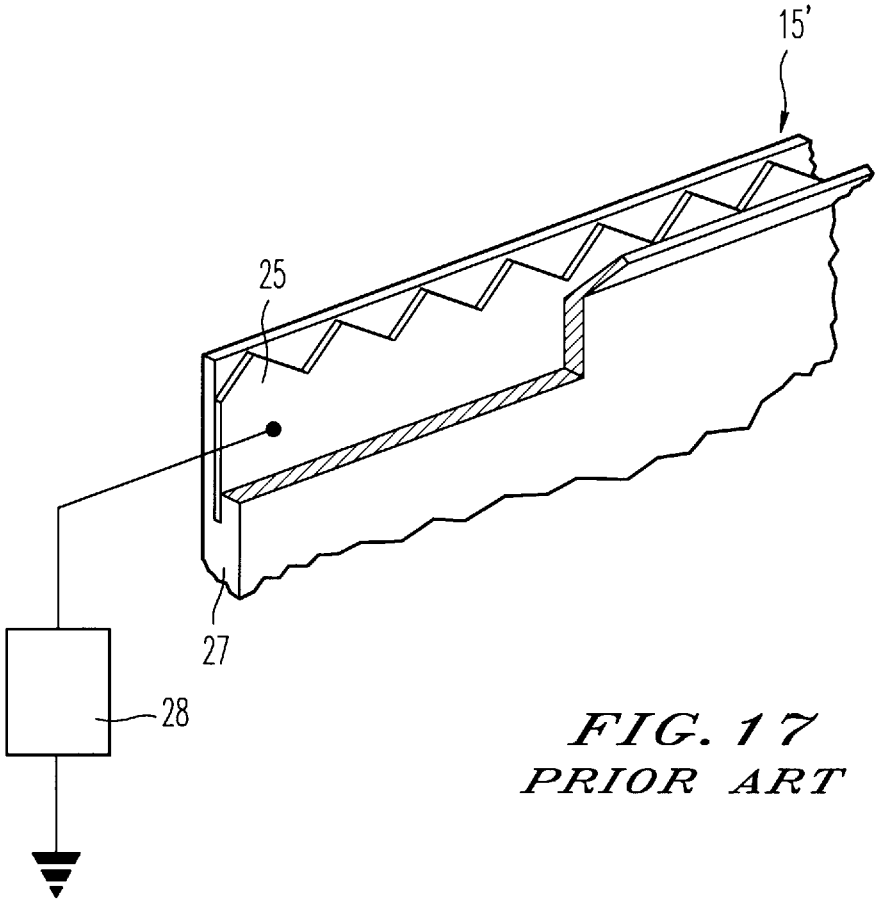
FIG. 17 PRIOR ART
FIG. 17 is a schematic perspective drawing illustrating the discharging device shown in FIG. 16.

FIG. 17 is a schematic drawing illustrating an example of a structure of the discharging device 15'. As shown, the discharging device 15' includes an insulating supporting member 27 and a conductive member 25 having a saw-toothed upper end and being assembled integrally with the supporting member 27 with the saw-toothed upper end exposed above the supporting member 27. The conductive member 25 is connected to a high voltage power source 28. The transfer sheet entrance guide 5 and the conveying guide plate 11 in FIG. 16 are both insulating. The conductive member 25 is placed below the transfer sheet 6 and discharges the transfer sheet 6 which has been separated from the photoconductor 1 by its own bouncing force and weight. The discharger 15' is provided only for discharging the transfer sheet 6 which has been separated from the photoconductor 1 and is not provided for the purpose of separating the transfer sheet 6 from the photoconductor 1 in this example.

However, the discharger 15' as shown in FIGS. 16 and 17 requires the high voltage power source 28 whose cost is relatively high, and therefore use of such discharger 15' for discharging the transfer sheet 6 may also offset the cost reduction which is achieved by eliminating the device to separate the transfer sheet 6 from the photoconductor 1 by the use of the small-diameter photoconductor 1.

Figure 18:
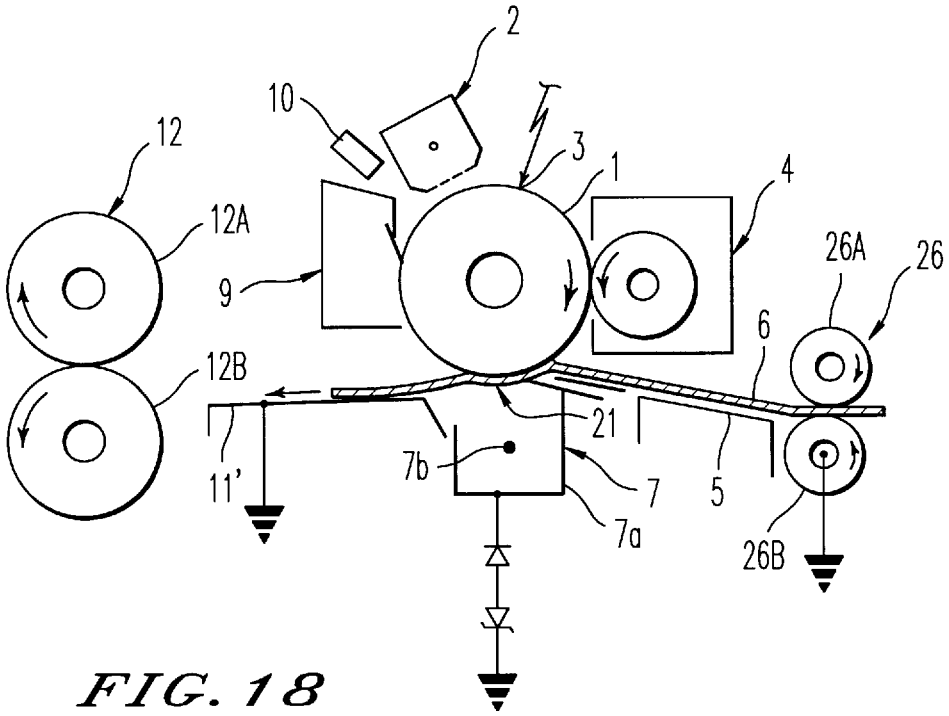
FIG. 18 is a schematic drawing illustrating the main parts of another embodiment including members to uniformly leak charge.

In another embodiment of the present invention, illustrated in FIG. 18, the device to discharge the transfer sheet 6, such as the discharger 15 in FIGS. 9 and 10 or the discharger 15' in FIGS. 16 and 17, is not provided, and instead, two registration rollers 26A and 26B are arranged for conveying the transfer sheet 6 upstream of the transfer area 21 in the transfer sheet conveying direction, and at least the registration roller 26B, which contacts the back side of the transfer sheet 6, is made of a conductive material and is grounded. Further, the conveying guide plate 11' arranged in the downstream of the transfer area 21 in the transfer sheet conveying direction is made of a conductive material and is grounded. The registration roller 26B and the conveying guide plate 11' are arranged so that the transfer sheet 6 contacts either the registration roller 26B or the conveying guide plate 11' when transferring a toner image on the surface of the photoconductor 1 to the transfer sheet 6 by means of corona charging by the transfer charger 7.

When humidity becomes high and moisture absorption of the transfer sheet 6 increases, resistance of the transfer sheet 6 decreases. If a toner image on the surface of the photoconductor 1 is transferred to the transfer sheet 6 in such a state, that is, when resistance of the transfer sheet 6 is decreased, charge applied by the transfer charger 7 to the transfer sheet 6 leaks to the registration roller 26B or the conveying guide plate 11', or to both of them, because the transfer sheet 6 contacts at least one of them. Thus by leaking the charge uniformly, uneven charge, which is caused by uneven leakage of the charge through the transfer sheet 6, does not occur. Therefore, blurring of transferred image, which is caused by uneven charge when transferring an image, does not occur even under high humidity conditions.

In more in detail, when the leading edge of the transfer sheet 6 has not reached the conveying guide plate 11', the transfer sheet 6 contacts the registration roller 26B. Therefore, the charge from the transfer charger 7 flows through the back surface of the transfer sheet 6 and leaks to the ground through the registration roller 26B. Further, when the trailing edge of the transfer sheet 6 passes the registration roller 26B, the transfer sheet 6 is contacting the conveying guide plate 11'. Therefore, the charge flows through the back surface of the transfer sheet 6 and leaks to ground through the conveying guide plate 11'. Thus, the charge applied to the transfer sheet 6 leaks to the ground while a toner image is being transferred from the photoconductor 1, thereby occurrence of uneven charge is eliminated and accordingly occurrence of inferior image on the entire surface of the transfer sheet 6 due to uneven charge is avoided even when a discharging device such as the discharger 15' shown in FIG. 16 is not provided.

If a member for leaking the charge on the transfer sheet 6 to the ground is only provided upstream of the transfer charger 7 in the transfer sheet conveying direction, such as the registration roller 26B in the above embodiment, the charge on the transfer sheet 6 does not leak to the ground once the transfer sheet 6 passes such member. If a member for leaking the charge on the transfer sheet 6 to the ground is only provided downstream of the transfer charger 7, such as the conveying guide plate 11', the charge on the transfer sheet 6 can not be leaked to the ground until the transfer sheet 6 reaches the conveying guide plate 11'. In either of the these arrangements, blurring of the transferred image occurs under high humidity conditions, which is prevented with the arrangement of this invention shown in FIG. 18.

Under normal or low humidity conditions, moisture absorption of the transfer sheet 6 is low and resistance of the transfer sheet 6 increases. Therefore, charge applied by the transfer charger 7 to the transfer sheet 6 when transferring a toner image does not leak to the registration roller 26B or the conveying guide plate 11' at all or in a substantial amount. Under low humidity conditions, therefore, uneven charge does not occur and accordingly it does not occur that the image is blurred. Further, because the charge is not leaked to the ground, current to be supplied to the wire electrode 7*b* of the transfer charger 7 is minimized, thereby ozone generated by the corona charging of the transfer charger 7 is also minimized. Further, because supply current to the transfer charger 7 needs not be increased either in high humidity condition or low humidity condition, the supply current to the transfer charger 7 can be made constant, thereby control of the transfer charger 7 is simplified.

As explained above, by making members for conveying the transfer sheet 6, such as the registration roller 26B and the conveying guide plate 11', with a material which can leak the charge and further by simply grounding these units, occurrence of uneven charge during image transfer can be avoided and thereby occurrence of abnormal image under high humidity conditions is avoided. Further, the construction of the image forming apparatus is simplified and the cost of the apparatus is reduced by using such members as the registration roller 26B and the conveying guide plate 11', which are indispensable for the image forming operations.

As the conductive member for leaking the charge on the transfer sheet 6, which is to be arranged in the upstream or the downstream of the transfer charger 7 in the conveying direction of the transfer sheet 6, members other than the registration roller 26B and the conveying guide plate 11' can be used.

Figure 19:
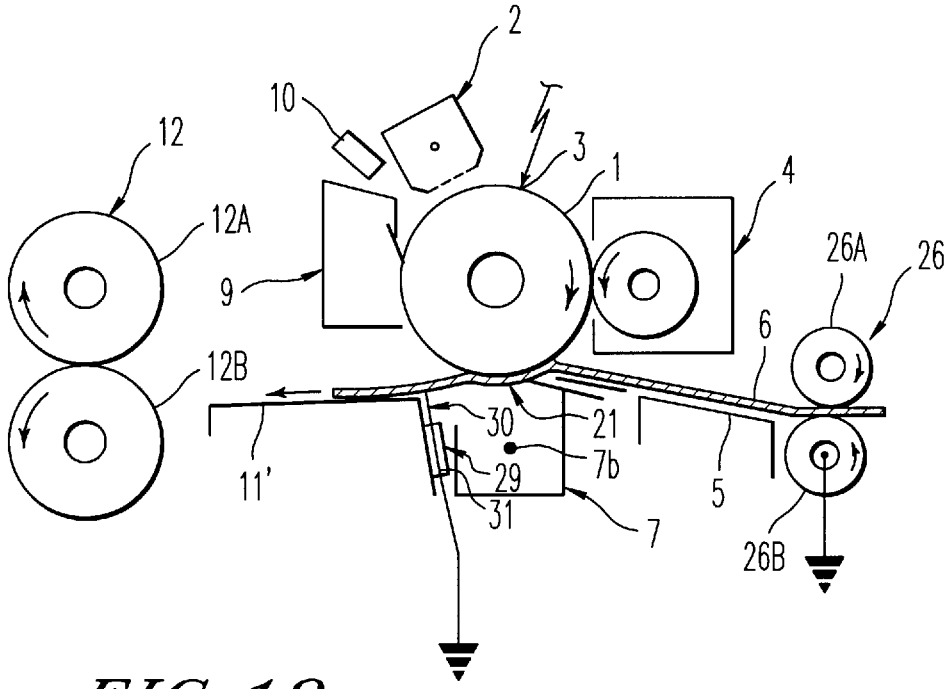
FIG. 19 is a schematic drawing illustrating another embodiment including a member to uniformly leak charge downstream of the transfer device.

For example, in the embodiment shown in FIG. 19, the registration roller 26B is used as the member for leaking the charge arranged upstream of the transfer charger 7 as in the embodiment shown in FIG. 18, and as the member for leaking the charge arranged in the downstream of the transfer charger 7, a conductive grounding member 29, which is equivalent to the discharger 15 in the previous embodiment shown in FIG. 9 and which includes a conductive brush 30 and a conductive brush support member 31. As shown in FIG. 19, the conductive brush support member 31 is grounded. In this embodiment, the conductive grounding member 29 is mounted in a fixed position to the conveying guide plate 11' which is made of an insulating material. The transfer sheet entrance guide 5 is also made of an insulating material. The other parts are same as the embodiment shown in FIG. 18.

The conductive brush 30 contacts the back surface of the transfer sheet 6 which has been separated from the photoconductor 1 by its own bouncing force and weight and is being conveyed toward the fixing unit 12, and thereby the charge applied by the transfer charger 7 to the transfer sheet 6 when transferring a toner image thereupon is leaked to the ground through the brush support member 31. Therefore, in high humidity conditions, even after the transfer sheet 6 passes the registration roller 26B, the charge applied to the transfer sheet 6 leaks through the conductive grounding member 29 including the conductive brush 30 and the brush support member 31.

Other operations are the same as in the embodiment shown in FIG. 18. In low humidity conditions, the charge applied to the transfer sheet 6 is not leaked to the registration roller 26B or to the conductive grounding member 29. Thus, occurrence of an abnormal transferred image due to uneven charge during image transfer is prevented in this embodiment.

Alternatively, the transfer sheet entrance guide 5 shown in FIGS. 18 and 19 may be made of a conductive material and grounded, so that the transfer sheet entrance guide 5 is used as the conductive grounding member upstream of the transfer charger 7. As an additional alternative, other rollers, belts or the like which are used for conveying the transfer sheet 6 may be used as conductive grounding members.

If these conductive grounding members are arranged close to the transfer charger 7, the charge from the transfer charger 7 leaks to these conductive grounding members through the air. If such leakage occurs, supply current to the transfer charger 7 has to be increased, increasing costs and ozone production. Therefore, when corona wire charging is employed in the transfer charger 7, these conductive grounding members need to be separated from the transfer charger 7 to an extent such that the charge of the transfer charger 7 does not leak through the air to the conductive grounding members. By thus arranging the conductive grounding members, increased cost and ozone production is prevented.

In the embodiment shown in FIGS. 18 and 19, although the transfer charger 7 with corona charging is shown, instead of the transfer charger 7 a transfer roller which rotates while pressing and contacting the surface of the photoconductor 1 via the transfer sheet 6 and charges the transfer sheet 6 with an opposite polarity to the toner to transfer the toner image from the photoconductor 1 to the transfer sheet 6 may be used.

In all of the above embodiments, although the drum-shaped photoconductor 1 is used, it is needless to say that a belt-shaped photoconductor 1 may also be used instead of the drum-shaped photoconductor 1.

Further, although a device having a wire electrode is used as the transfer device in the above-mentioned embodiments, it is needless to say that any type of transfer device may be substituted, for example a transfer device utilizing a needle-type electrode.

Obviously numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patents of the United States is:

1. An image forming apparatus comprising:

an image carrier having a circumferential surface;

a transfer device to transfer an image formed on the image carrier to a transfer sheet, the transfer device being arranged in a position separated from the image carrier and the transfer sheet being conveyed along and contacting a contact area of the circumferential surface of the image carrier facing the transfer device; and a conveying guide to guide and convey the transfer sheet after separation from the image carrier to a fixing unit, the conveying guide having a guiding member configured so as to direct a conveying direction of the transfer sheet upward when a leading edge of the transfer sheet contacts the guiding member and to convey the transfer sheet at a part of the conveying guide or the guiding member in a position higher than the position of the leading edge of the transfer sheet contacting the conveying guide or the guiding member so that the contact area of the transfer sheet with the image carrier increases wherein the transfer sheet separates from the image carrier without a discharging operation of a charge on the transfer sheet.

2. An image forming apparatus, comprising:

an image carrier having a circumferential surface;

a transfer device to transfer an image formed on the image carrier to a transfer sheet, the transfer device being arranged in a position separated from the image carrier and the transfer sheet being conveyed along and contacting a contact area of the circumferential surface of the image carrier facing the transfer device; and a conveying guide to guide and convey the transfer sheet after separation from the image carrier to a fixing unit the conveying guide having a guiding member configured so as to direct a conveying direction of the transfer sheet upward when a leading edge of the transfer sheet contacts the guiding member and to convey the transfer sheet at a part of the conveying guide or the guiding member in a position higher than the position of the leading edge of the transfer sheet contacting the conveying guide or the guiding member so that the contact area of the transfer sheet with the image carrier increases, wherein the guiding member provided to the conveying guide extends upward from the conveying guide, inclining toward the conveying direction of the transfer sheet.

3. An image forming apparatus, comprising:

an image carrier having a circumferential surface;

a transfer device to transfer an image formed on the image carrier to a transfer sheet, the transfer device being arranged in a position separated from the image carrier and the transfer sheet being conveyed along and contacting a contact area of the circumferential surface of the image carrier facing the transfer device; and a conveying guide to guide and convey the transfer sheet after separation from the image carrier to a fixing unit, the conveying guide having a guiding member configured so as to direct a conveying direction of the transfer sheet upward when a leading edge of the transfer sheet contacts the guiding member and to convey the transfer sheet at a part of the conveying guide or the guiding member in a position higher than the position of the leading edge of the transfer sheet contacting the conveying guide or the guiding member so that the contact area of the transfer sheet with the image carrier increases, wherein:

the guiding member is formed integrally with the conveying guide at a side of the transfer device and extends downward therefrom inclining toward a direction opposite to the conveying direction of the transfer sheet, and the conveying guide is arranged so that the leading edge of the conveyed transfer sheet contacts the guiding member.

4. The image forming apparatus according to claim 3, wherein the conveying guide is configured and arranged so that an extension line extending from a free end of the inclined guiding member does not directly enter inside of a casing of the transfer device.

5. An image forming apparatus, comprising:

an image carrier having a circumferential surface;

a transfer device to transfer an image formed on the image carrier to a transfer sheet, the transfer device being arranged in a position separated from the image carrier and the transfer sheet being conveyed along and contacting a contact area of the circumferential surface of the image carrier facing the transfer device; and a conveying guide to guide and convey the transfer sheet after separation from the image carrier to a fixing unit the conveying guide having a guiding member configured so as to direct a conveying direction of the transfer sheet upward when a leading edge of the transfer sheet contacts the guiding member and to convey the transfer sheet at a part of the conveying guide or the guiding member in a position higher than the position of the leading edge of the transfer sheet contacting the conveying guide or the guiding member so that the contact area of the transfer sheet with the image carrier increases, wherein the guiding member for directing the conveying direction of the transfer sheet upward is a discharging device to discharge the transfer sheet after separation from the image carrier.

6. The image forming apparatus according to claim 5, wherein the discharging device is held rotatably so as to move between a first position to direct the conveying direction of the transfer sheet upward so that the contact area between the transfer sheet and the image carrier increases and a second position recessed from the first position.

7. The image forming apparatus according to claim 6, further comprising a means for dislocating the discharging device from the first position to the second position immediately before a trailing edge of the transfer sheet reaches a position where the transfer device transfers the image.

8. The image forming apparatus according to claim 6, further comprising an insulating member at a part of the discharging device facing the transfer device.

9. The image forming apparatus according to claim 5, further comprising an insulating member at a part of the discharging device facing the transfer device.

10. An image forming apparatus comprising:

an image carrier having a circumferential surface;

a transfer device to transfer an image formed on the image carrier to a transfer sheet, the transfer device being arranged in a position separated from the image carrier and the transfer sheet being conveyed along and contacting a contact area of the circumferential surface of the image carrier facing the transfer device;

a conveying guide to guide and convey the transfer sheet after separation from the image carrier to a fixing unit, the conveying guide having a guiding member configured so as to direct a conveying direction of the transfer sheet upward when a leading edge of the transfer sheet contacts the guiding member and to convey the transfer sheet at a part of the conveying guide or the guiding member in a position higher than the position of the leading edge of the transfer sheet contacting the conveying guide or the guiding member so that the contact area of the transfer sheet with the image carrier increases; and a discharging device at the guiding member of the conveying guide to discharge the transfer sheet separated from the image carrier, the discharging device being configured so as to direct the conveying direction of the transfer sheet upward when the leading edge of the transfer sheet contacts the discharging device and to convey the transfer sheet at a part of the discharging device in a position higher than the position of the leading edge of the transfer sheet contacting the discharging device so that the contact area of the transfer sheet with the image carrier increases.

11. The image forming apparatus according to claim 10, wherein the discharging device is held rotatably so as to move between a first position to direct the conveying direction of the transfer sheet upward so that the contact area between the transfer sheet and the image carrier increases and a second position recessed from the first position.

12. The image forming apparatus according to claim 11, further comprising means for dislocating the discharging device from the first position to the second position immediately before a trailing edge of the transfer sheet reaches a position where the transfer device transfers the image.

13. The image forming apparatus according to claim 11, further comprising an insulating member at a part of the discharging device facing the transfer device.

14. The image forming apparatus according to claim 10, further comprising an insulating member at a part of the discharging device facing the transfer device.

15. An image forming apparatus comprising:

image carrier having a circumferential surface;

a transfer device to transfer an image formed on the image carrier to a transfer sheet, the transfer device being arranged in a position separated from the image carrier and the transfer sheet being conveyed along and contacting a contact area of the circumferential surface of the image carrier facing the transfer device;

a conveying guide to guide and convey the transfer sheet after separation from the image carrier to a fixing unit, the conveying guide having a guiding member configured so as to direct a conveying direction of the transfer sheet upward when a leading edge of the transfer sheet contacts the guiding member and to convey the transfer sheet at a part of the conveying guide or the guiding member in a position higher than the position of the leading edge of the transfer sheet contacting the conveying guide or the guiding member so that the contact area of the transfer sheet with the image carrier increases; and a conductive grounding member contacting the transfer sheet upstream of the transfer device in the conveying direction of the transfer sheet, and wherein the conveying guide is conductive and the conductive grounding member upstream of the transfer device and the conductive conveying guide are arranged so that the transfer sheet contacts at least one of the conductive grounding member and the conveying guide when transferring the image formed on the image carrier to the transfer sheet.

16. An image forming apparatus comprising:

an image carrier;

a transfer device to transfer an image formed on the image carrier to a transfer sheet, the transfer device being arranged in a position separated from the image carrier and the transfer sheet being conveyed along and contacting a contact area on a part of a circumferential surface of the image carrier facing the transfer device; and a conveying guide to guide and convey the transfer sheet after separating from the image carrier to a fixing unit, the conveying guide having a guiding member configured so as to guide the transfer sheet separated from the image carrier upward from the conveying guide and to form a convex curve in the transfer sheet toward an area at a side of the image carrier in a transfer sheet conveying direction and to increase the contact area of the transfer sheet with the image carrier, wherein the transfer sheet separates from the image carrier without a discharging operation of a charge on the transfer sheet.

17. An image forming apparatus, comprising:

an image carrier;

a transfer device to transfer an image formed on the image carrier to a transfer sheet, the transfer device being arranged in a position separated from the image carrier and the transfer sheet being conveyed along and contacting a contact area on a part of a circumferential surface of the image carrier facing the transfer device; and a conveying guide to guide and convey the transfer sheet after separating from the image carrier to a fixing unit, the conveying guide having a guiding member configured so as to guide the transfer sheet separated from the image carrier upward from the conveying guide and to form a convex curve in the transfer sheet toward an area at a side of the image carrier in a transfer sheet conveying direction and to increase the contact area of the transfer sheet with the image carrier, wherein the guiding member extends upward from the conveying guide, inclining toward the conveying direction of the transfer sheet.

18. An image forming apparatus, comprising:

an image carrier;

a transfer device to transfer an image formed on the image carrier to a transfer sheet, the transfer device being arranged in a position separated from the image carrier and the transfer sheet being conveyed along and contacting a contact area on a part of a circumferential surface of the image carrier facing the transfer device; and a conveying guide to guide and convey the transfer sheet after separating from the image carrier to a fixing unit, the conveying guide having a guiding member configured so as to guide the transfer sheet separated from the image carrier upward from the conveying guide and to form a convex curve in the transfer sheet toward an area at a side of the image carrier in a transfer sheet conveying direction and to increase the contact area of the transfer sheet with the image carrier, wherein the guiding member is formed integrally with the conveying guide at a side of the transfer device and extends downward therefrom inclining toward a direction opposite to the conveying direction of the transfer sheet, and the conveying guide is arranged so that a leading edge of the conveyed transfer sheet contacts the guiding member.

19. The image forming apparatus according to claim 18, wherein the conveying guide is configured and arranged so that an extension line extending from a free end of the inclined guiding member does not directly enter inside a casing of the transfer device.

20. An image forming apparatus, comprising:

an image carrier;

a transfer device to transfer an image formed on the image carrier to a transfer sheet, the transfer device being arranged in a position separated from the image carrier and the transfer sheet being conveyed along and contacting a contact area on a part of a circumferential surface of the image carrier facing the transfer device; and a conveying guide to guide and convey the transfer sheet after separating from the image carrier to a fixing unit, the conveying guide having a guiding member configured so as to guide the transfer sheet separated from the image carrier upward from the conveying guide and to form a convex curve in the transfer sheet toward an area at a side of the image carrier in a transfer sheet conveying direction and to increase the contact area of the transfer sheet with the image carrier, wherein the guiding member is a discharging device to discharge the transfer sheet after separation from the image carrier.

21. The image forming apparatus according to claim 20, wherein the discharging device is held rotatably so as to move between a first position to guide the transfer sheet separated from the image carrier upward from the conveying guide so that the contact area between the transfer sheet and the image carrier increases and a second position recessed from the first position.

22. The image forming apparatus according to claim 21, further comprising a means for dislocating the discharging device from the first position to the second position immediately before a trailing edge of the transfer sheet reaches a position where the transfer device transfers the image.

23. The image forming apparatus according to claim 21, further comprising an insulating member at a part of the discharging device facing the transfer device.

24. The image forming apparatus according to claim 20, further comprising an insulating member at a part of the discharging device facing the transfer device.

25. An image forming apparatus comprising:

an image carrier;

a transfer device to transfer an image formed on the image carrier to a transfer sheet, the transfer device being arranged in a position separated from the image carrier and the transfer sheet being conveyed along and contacting a contact area on a part of a circumferential surface of the image carrier facing the transfer device;

a conveying guide to guide and convey the transfer sheet after separating from the image carrier to a fixing unit, the conveying guide having a guiding member configured so as to guide the transfer sheet separated from the image carrier upward from the conveying guide and to form a convex curve in the transfer sheet toward an area at a side of the image carrier in a transfer sheet conveying direction and to increase the contact area of the transfer sheet with the image carrier; and a discharging device at the guiding member of the conveying guide to discharge the transfer sheet separated from the image carrier, the discharging device being configured so as to guide the transfer sheet separated from the image carrier upward from the conveying guide and to form a convex curve in the transfer sheet toward an area at a side of the image carrier in the transfer sheet conveying direction so that the contact area of the transfer sheet with the image carrier increases.

26. The image forming apparatus according to claim 25, wherein the discharging device is held rotatably so as to move between a first position to guide the transfer sheet upward from the conveying guide so that the contact area increases and a second position recessed from the first position.

27. The image forming apparatus according to claim 26, further comprising a means for dislocating the discharging device from the first position to the second position immediately before a trailing edge of the transfer sheet reaches a position where the transfer device transfers the image.

28. The image forming apparatus according to claim 27, further comprising an insulating member at a part of the discharging device facing the transfer device.

29. The image forming apparatus according to claim 25, further comprising an insulating member at a part of the discharging device facing the transfer device.

30. An image forming apparatus comprising:

an image carrier;

a transfer device to transfer an image formed on the image carrier to a transfer sheet, the transfer device being arranged in a position separated from the image carrier and the transfer sheet being conveyed along and contacting a contact area on a part of a circumferential surface of the image carrier facing the transfer device;

a conveying guide to guide and convey the transfer sheet after separating from the image carrier to a fixing unit, the conveying guide having a guiding member configured so as to guide the transfer sheet toward an area at a side of the image carrier in a transfer sheet conveying direction and to increase the contact area of the transfer sheet with the image carrier; and a conductive grounding member contacting the transfer sheet upstream of the transfer device in the conveying direction of the transfer sheet, and wherein the conveying guide is conductive and the conductive grounding member upstream of the transfer device and the conductive conveying guide are arranged so that the transfer sheet contacts at least one of the conductive grounding member and the conveying guide when transferring the image formed on the image carrier to the transfer sheet.

* * * * *